US006342856B1

(12) United States Patent
Nakano et al.

(10) Patent No.: US 6,342,856 B1
(45) Date of Patent: Jan. 29, 2002

(54) METHOD OF FEEDING FLAT ANTENNA, AND FLAT ANTENNA

(75) Inventors: Hisamatsu Nakano, Tokyo; Masaaki Miyata, Kanagawa; Kotaro Fujimori, Tokyo; Hiroaki Mimaki, Tokyo; Junji Yamauchi, Tokyo, all of (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 09/582,073

(22) PCT Filed: Jan. 11, 1999

(86) PCT No.: PCT/JP99/00052

§ 371 Date: Jun. 21, 2000

§ 102(e) Date: Jun. 21, 2000

(87) PCT Pub. No.: WO99/36991

PCT Pub. Date: Jul. 22, 1999

(30) Foreign Application Priority Data

Jan. 13, 1998 (JP) ..... 10-005143
Jan. 13, 1998 (JP) ..... 10-005144
Sep. 21, 1998 (JP) ..... 10-267089

(51) Int. Cl.[7] ..... H01Q 1/38; H01Q 7/00

(52) U.S. Cl. ..... 343/700 MS; 343/769; 343/866

(58) Field of Search ..... 343/700 MS, 846, 343/848, 790, 829, 830, 767, 769, 866, 867, 741, 742; H01Q 1/38, 7/00

(56) References Cited

U.S. PATENT DOCUMENTS 4,903,033 A * 2/1990 Tsao et al. ..... 343/700 MS
5,165,109 A * 11/1992 Han et al. ..... 343/700 MS
5,661,494 A * 8/1997 Bondyopadhyay ... 343/700 MS

* cited by examiner

*Primary Examiner*—Hoanganh Le
(74) *Attorney, Agent, or Firm*—Fattibene & Fattibene; Paul A. Fattibene; Arthur T. Fattibene

(57) ABSTRACT

A thin plane antenna that copes with the horizontally polarized waves and the vertically polarized waves, or the levo-rotary polarized waves and the dextro-rotary polarized waves, and in which a loop-shaped plane antenna element (12) is arranged in parallel with a ground plane (15), and a first feeder conductor (13) and a second feeder conductor (14) having feeding points displayed by 90 degrees are arranged between the plane antenna element and the ground plane. Central conductors **(18*a*) and (19*a*) of the coaxial lines are connected to the first and second feeder conductors, and external conductors (18*b*) and (19*b*) thereof are connected to the ground plane to feed electric power to the antenna element through the electromagnetic coupling. When the electric power is fed from the first feeder conductor (13), the horizontally polarized waves are radiated and when the electric power is fed from the second feeder conductor (14)**, the vertically polarized waves are radiated. Upon changing over the first and second feeder conductors, the horizontally polarized waves and the vertically polarized waves can be transmitted and received. By providing the horizontal antenna element with slide elements, further, the levo-rotary polarized waves and the dextro-rotary polarized waves can be transmitted and received.

15 Claims, 10 Drawing Sheets

METHOD OF FEEDING FLAT ANTENNA, AND FLAT ANTENNA

TECHNICAL FIELD

The present invention relates to a method of feeding electric power to a plane antenna and to a plane antenna. More particularly, the invention relates a method of feeding electric power to a plane antenna which is designed for decreasing the thickness and for facilitating the assembling, and to a plane antenna capable of transmitting and receiving vertically polarized waves and horizontally polarized waves, or levo-rotary polarized waves and dextro-rotary polarized waves.

BACKGROUND ART

There has heretofore been known a plane antenna using a loop-type antenna element. In the plane antenna of this kind, both ends of a square or a circular loop-like antenna element are connected to balanced line connection terminals of a balanced-to-unbalanced conversion circuit and of an impedance conversion circuit through balanced feeder lines, and unbalanced line connection terminals of the balanced-to-unbalanced conversion circuit and of the impedance conversion circuit are connected to a receiver or to a transmitter through a coaxial cable.

When a feeding point is provided on a horizontal portion of the antenna element, there is obtained a plane antenna for the horizontally polarized waves and when a feeding point is located on a vertical portion, there is obtained a plane antenna for the vertically polarized waves.

If the loop-type antenna element is provided with slide element portions, a phase difference of 90 degrees is produced between the horizontally polarized waves and the vertically polarized waves due to the reactance formed by the areas and shape of the slide element portions, whereby the linearly polarized waves are converted into circularly polarized waves, forming a plane antenna for the circularly polarized waves. When the slide elements are provided at positions of about −45 degrees and about +135 degrees from the power-feeding point of the antenna element as viewed from the front, there is obtained a plane antenna for levo-rotary polarized waves. When the slide elements are arranged at positions of about +45 degrees and about −135 degrees from the power-feeding point of the antenna element as viewed from the front, there is obtained a plane antenna for the dextro-rotary polarized waves.

Thus, the conventional plane antenna requires a balanced-to-unbalanced conversion circuit and an impedance conversion circuit, i.e., requires an increased number of parts and an increased number of assembling steps, driving up the cost. It has therefore been desired to provide a plane antenna in a small size having a decreased thickness. Besides, a single antenna is not capable of transmitting and receiving horizontally polarized waves and vertically polarized waves, or levo-rotary polarized waves and dextro-rotary polarized waves. To cope with two kinds of polarization modes of the horizontally polarized waves and vertically polarized waves, or the levo-rotary polarized waves and dextro-rotary polarized waves, there must be installed antennas of two systems occupying considerable space and requiring a cost.

Thus, there arouses a technical problem that must be solved for providing a plane antenna which is fabricated using a decreased number of parts in a small size, and which is capable of coping with the two kinds of polarization modes of the horizontally polarized waves and vertically polarized waves or the levo-rotary polarized waves and dextro-rotary polarized waves, though the antenna is used in a number of only one.

DISCLOSURE OF THE INVENTION

The invention was proposed in order to accomplish the above-mentioned object, and provides a method of feeding electric power to a plane antenna in which a plane antenna element is arranged in parallel with a ground plane, a feeder conductor is arranged between the plane antenna element and the ground plane, the feeder conductor being in parallel with the peripheral edges of the plane antenna element, a central conductor of a coaxial line is connected to an end of the feeder conductor, and an external conductor of the coaxial line is connected to the ground plane so that the electric power is fed from the coaxial line to the plane antenna element through the electromagnetic coupling.

The invention further provides a plane antenna in which a square or a circular plane antenna element is disposed in parallel with a ground plane, feeding points of a first feeder conductor and of a second feeder conductor are arranged being separated away by 90 degrees from the center of the plane antenna element, the first feeder conductor and the second feeder conductor are provided in parallel with the peripheral edges of the plane antenna element between the plane antenna element and the ground plane, the central conductors of coaxial lines of two systems are separately connected to the feeding points of the first feeder conductor and of the second feeder conductor, and the external conductors of the coaxial lines of the two systems are connected to the ground plane to feed electric power from the first feeder conductor or the second feeder conductor to the plane antenna element through the electromagnetic coupling so as to transmit and receive the horizontally polarized waves and the vertically polarized waves.

The invention further provides a plane antenna in which a plane antenna element of the plane antenna having the first and second feeder conductors is further provided with slide elements positioned at an equal distance from the first and second feeding points so as to transmit and receive the levo-rotary polarized waves and the dextro-rotary polarized waves.

BEST MODE FOR CARRYING OUT THE INVENTION

Figure 1:
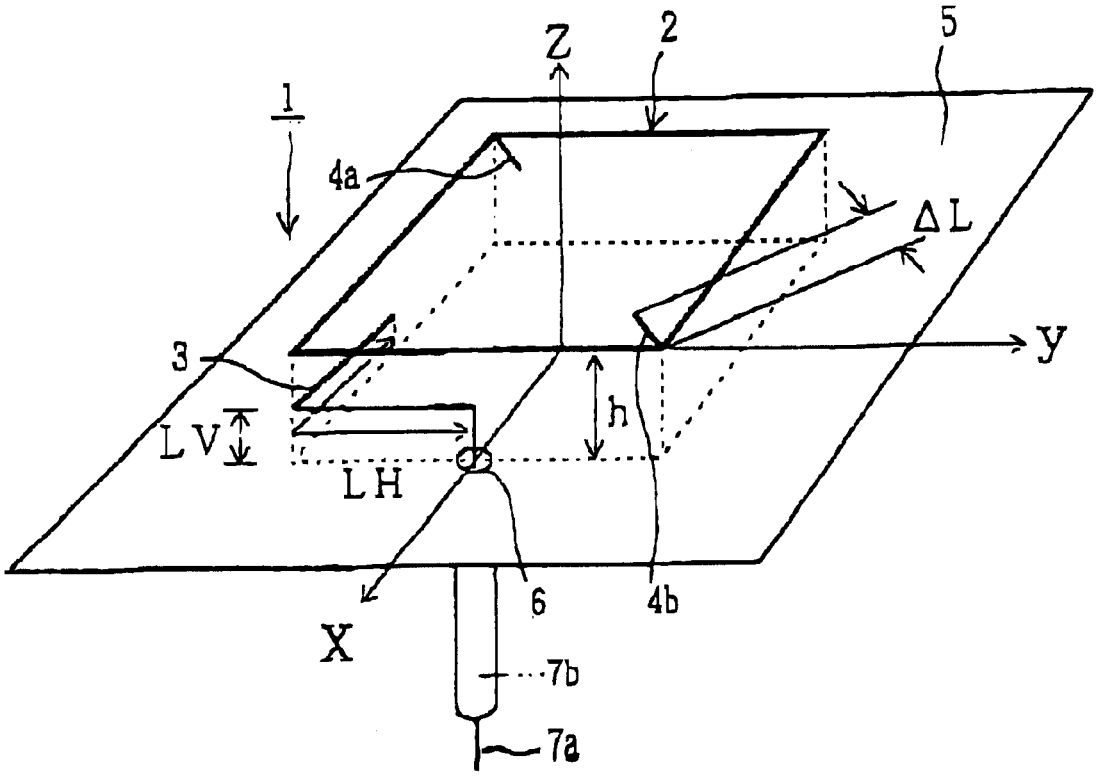
FIG. 1 is a diagram illustrating a method of feeding electric power to a plane antenna.

An embodiment of the invention will now be described with reference to the drawings. FIG. 1 is a diagram illustrating the structure of a plane antenna 1 for the dextro-rotary polarized waves, which is constituted by a plane antenna element 2 of the shape of a square loop having a circumferential length C (about one wavelength), an inverse L-shaped feeder conductor 3 having a length LV+LH, slide element portions 4*a* and 4*b* of a length ΔL for generating circularly polarized waves, and a ground plane 5 which is a metal plate having an area larger than that of the plane antenna element 2.

Here, let it now be presumed that the wire radius of the plane antenna element 2 is p, the height of the plane antenna element 2 from the ground plane 5 is h, the circumferential length is $C=1.032\lambda_{1.472}$, $h=0.0491\lambda_{1.472}$, $\Delta L=0.029\lambda_{1.472}$, $LV=0.014\lambda_{1.472}$, and $LH=0.236\lambda_{1.472}$, where $\lambda_{1.472}$ is a free space wavelength at a design frequency of 1.472 GHz.

The plane antenna element 2 is arranged over the ground plane 5 in parallel therewith. The ground plane 5 has a conductor through hole 6 facing a point of the loop of the plane antenna element 2. The feeder conductor 3 does not come in contact with the ground plane 5, rises upright through the conductor through hole 6, is bent in a horizontal direction, and is arranged in parallel with the plane antenna element 2 along the loop of the plane antenna element 2.

An end of the feeder conductor 3 penetrating through to the back surface side of the ground plane 5 is connected to a central conductor 7*a* of a coaxial feeder line, and an outer conductor 7*b* of the coaxial feeder line is connected to the ground plane 5, to feed electric power from the feeder conductor 3 to the ground plane 5 through the electromagnetic coupling.

Figure 2:
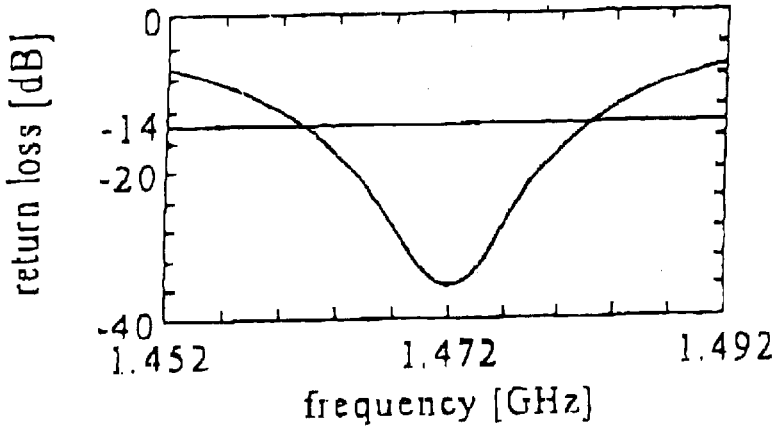
FIG. 2 is a graph of return loss characteristics of the plane antenna of FIG. 1.
Figure 3:
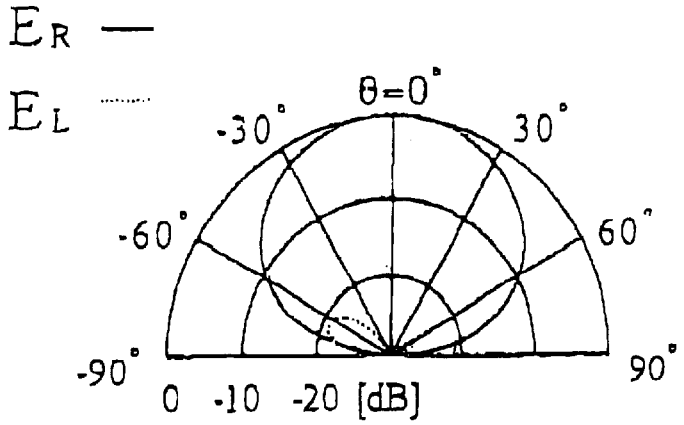
FIG. 3 is a graph of a radiation pattern of the plane antenna of FIG. 1 of when θ=0 degrees (front direction of the antenna)
Figure 4:
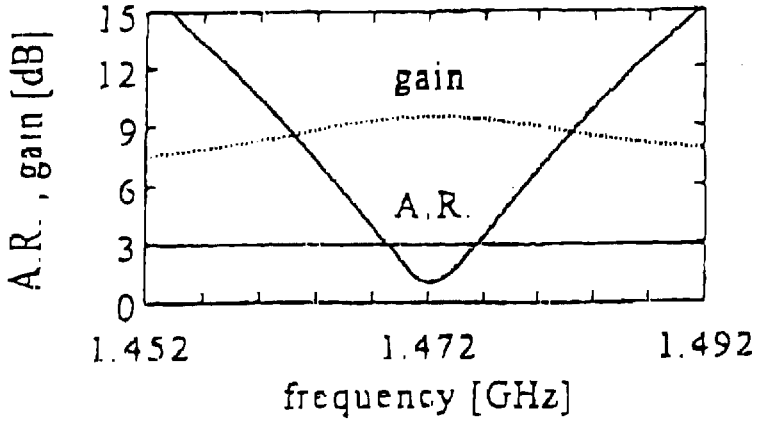
FIG. 4 is a graph of axis ratio and gain of the plane antenna of FIG. 1 depending on the frequency.

FIGS. 2 to 4 show characteristics of the plane antenna, wherein FIG. 2 shows return loss of a 50-ohm coaxial line. A band in which the return loss is not larger than −14 dB is 1.5% (from 1.461 GHz to 1.483 GHz).

FIG. 3 shows a radiation pattern of when θ=0 degree (direction of front surface of the antenna), wherein the half-power beam width of the dextro-rotary deflected waves ($E_R$) is about 70 degrees, and the inversely defected wave component ($E_L$) is −20 dB or smaller.

FIG. 4 shows the axis ratio (A.R.) and the gain depending on the frequency, wherein a circularly deflected wave radiation band in which the axis ratio is not larger than 3 dB is about 0.5%. The gain at a center frequency is 9.4 dB, and a change in the gain in this band is about 0.1 dB.

Though not diagramed, if the positions of the slide element portions 4*a* and 4*b* are turned by 180 degrees and the direction of the feeder conductor 3 is inverted right side left, then there is obtained a plane antenna for the levo-rotary polarized waves. If the slide element portions 4*a* and 4*b* are removed from the plane antenna element 2, then, there is obtained a plane antenna for the linearly polarized waves that correspond to the horizontally polarized waves or the vertically polarized waves.

Figure 5:
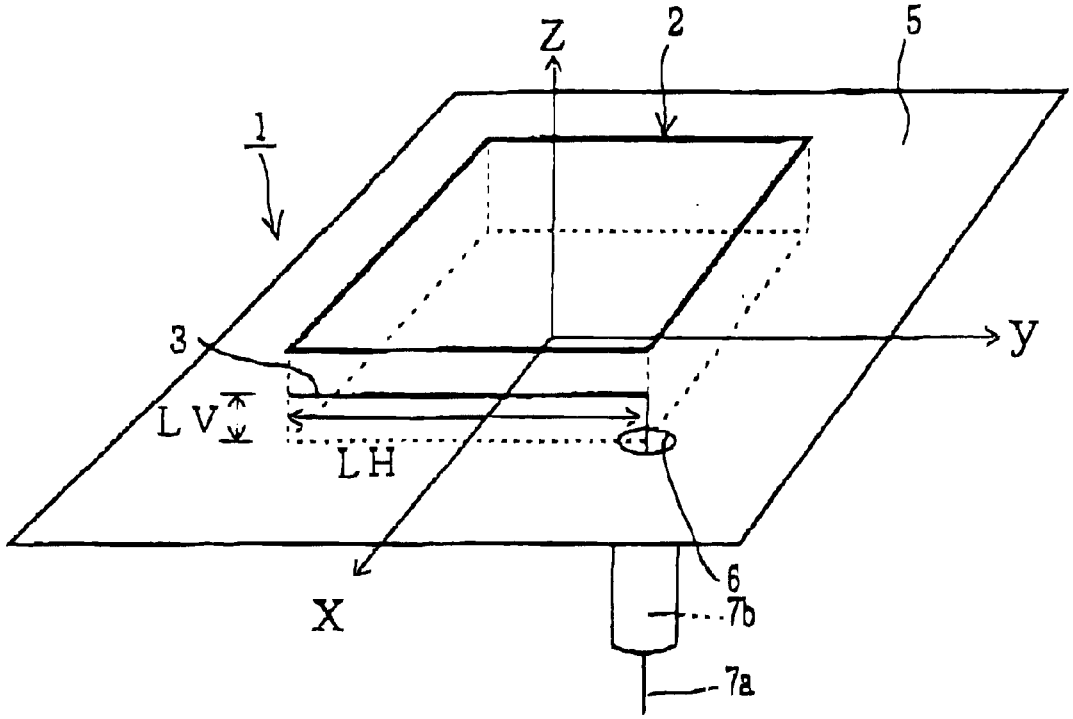
FIG. 5 is a diagram illustrating the plane antenna according to another embodiment.

FIG. 5 illustrates another embodiment in which the conductor through hole 6 is formed in the ground plane 5 at a position corresponding to a corner of the square plane antenna element 2, and the feeder conductor 3 is arranged in parallel with a side of the square plane antenna element 2.

Figure 6:
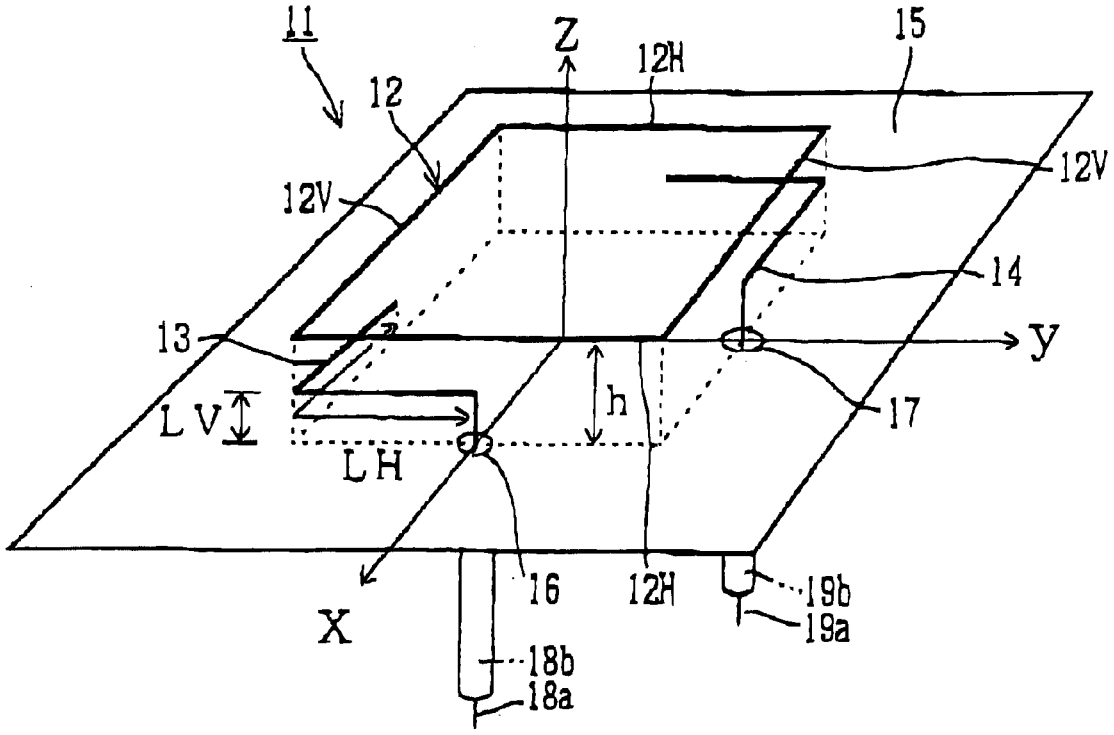
FIG. 6 is a diagram illustrating a plane antenna for the horizontally polarized waves and vertically polarized waves.

FIG. 6 is a diagram illustrating the structure of a plane antenna 11 capable of transmitting and receiving both the horizontally polarized waves and the vertically polarized waves, which is constituted by a plane antenna element of the shape of a square loop having a circumferential length C (about one wavelength), two feeder conductors 13 and 14 having a length LV+LH (about ¼ wavelength), and a ground plane 15.

The plane antenna element 12 is arranged over the ground plane 15 in parallel therewith, and the feeder conductors 13 and 14 of an inverse L-shape rising through the ground plane 15 are arranged between the plane antenna element 12 and the ground plane 15. The ground plane 15 has conductor through holes 16 and 17 just under an intermediate point of a horizontal element portion 12H of the plane antenna element 12 and just under an intermediate point of a vertical element portion 12V. The two feeder conductors 13 and 14 are not brought into contact with the ground plane 15 but are inserted at their ends which are the feeding points in the conductor through holes 16 and 17.

The feeder conductor 13 that vertically rises through the conductor through hole 16 facing the horizontal element portion 12H, is bent at right angles toward the left as viewed from the front, extends along the horizontal element portion 12 and the left vertical element portion 12V, and reaches an intermediate point of the left vertical element portion 12V. The feeder conductor 14 that vertically rises through the conductor through hole 17 facing the right vertical element portion 12V, is bent at right angles upward in FIG. 6, extends along the vertical element portion 12V and the upper horizontal element portion 12H, and reaches an intermediate point of the upper horizontal element portion 12H.

The ends of the feeder conductors 13 and 14 penetrating through to the back surface side of the ground plane 15 are connected to central conductors 18*a* and 19*a* of separate coaxial feeder lines, and external conductors 18*b* and 19*b* of the coaxial feeder lines are connected to the ground plane 5, to feed electric power from the feeder conductor 13 or 14 to the plane antenna element 12 through the electromagnetic coupling.

When the electric power is fed from the horizontal feeder conductor 13, the horizontally polarized waves are radiated from the plane antenna element 12 and when the electric power is fed from the vertical feeder conductor 14, the vertically polarized waves are radiated. Upon feeding the electric power by changing over the horizontal feeder conductor 13 and the vertical feeder conductor 14, the horizontally polarized waves and the vertically polarized waves can be received or transmitted using a single plane antenna 11.

The electric power is fed through the electromagnetic coupling to the plane antenna element 12 from the feeder conductors 13 and 14 arranged close to the plane antenna element 12 of the shape of a loop; i.e., the electric power is fed to the plane antenna element 12 by changing over the feeder lines of two systems to cope with both the horizontally polarized waves and the vertically polarized waves. The feeder lines are not connected to the plane antenna element 12 and have a low impedance, making it possible to decrease the gap between the antenna element and the ground plane and, hence, to constitute an antenna featuring small thickness and high sensitivity. The antenna can be easily assembled since no connection is necessary between the plane antenna element and the feeder lines.

Figure 7A:
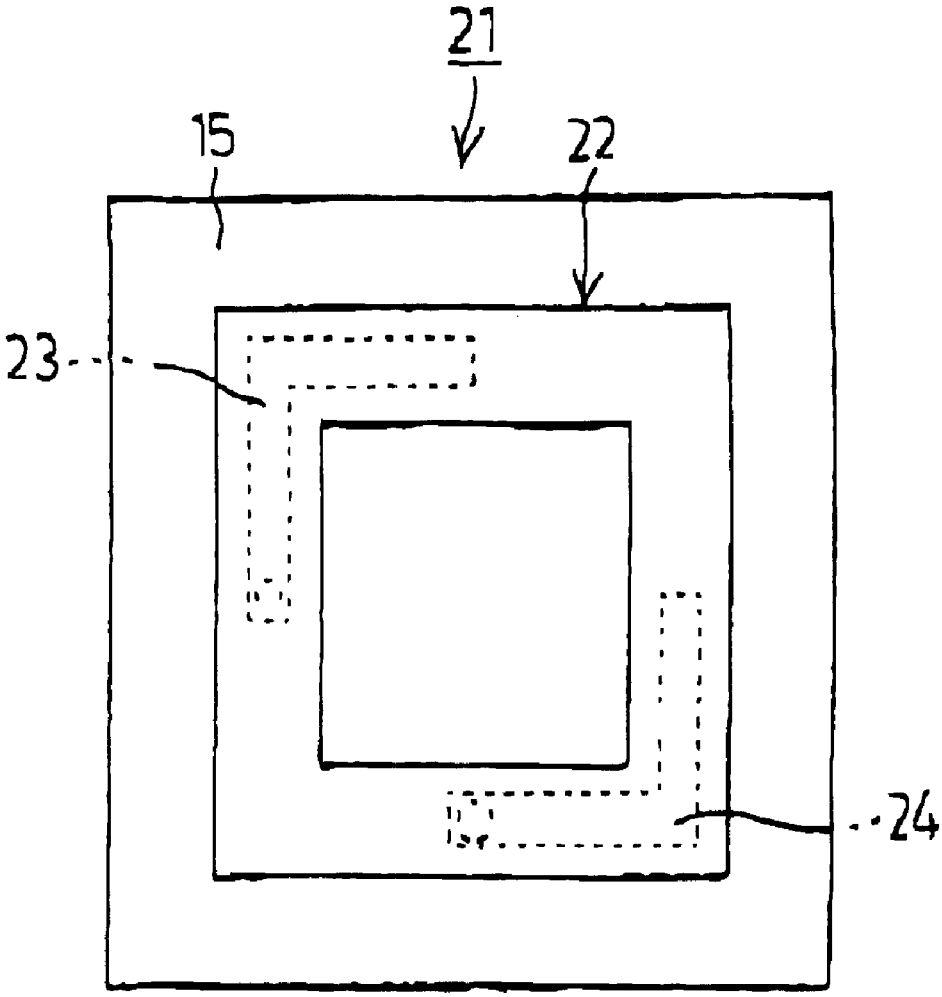
FIG. 7(*a*) is a front view of the plane antenna and FIG. 7(*b*) is a side view thereof.
Figure 7B:
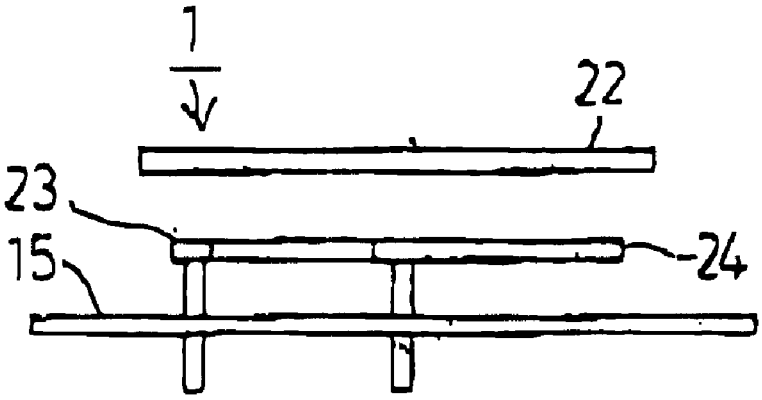

Referring to FIG. 7, a plane antenna element 22 of a plane antenna 21 for the horizontally/vertically polarized waves is formed of an electrically conducting metal plate in the shape of a plane square loop having a predetermined width in the radial direction. Feeder conductors 23 and 24 of an inverse L-shape, too, are formed of a metal plate like the plane antenna element 22, and have a width larger than the feeder conductors made of wires. An annular line passing through midway between the inner circumference and the outer circumference of the plane antenna element 22 has a circumferential length nearly equal to a free space wavelength $\lambda_{1.472}$ at a design frequency of 1.472 GHz. The difference is great between the inner circumferential length and the outer circumferential length, and the frequency band becomes broader than that of the constitution of FIG. 6. Similarly, the feeder conductors 23 and 24 of the shape of a flat plate offer a wider frequency band than the feeder conductors made of wires.

Figure 8:
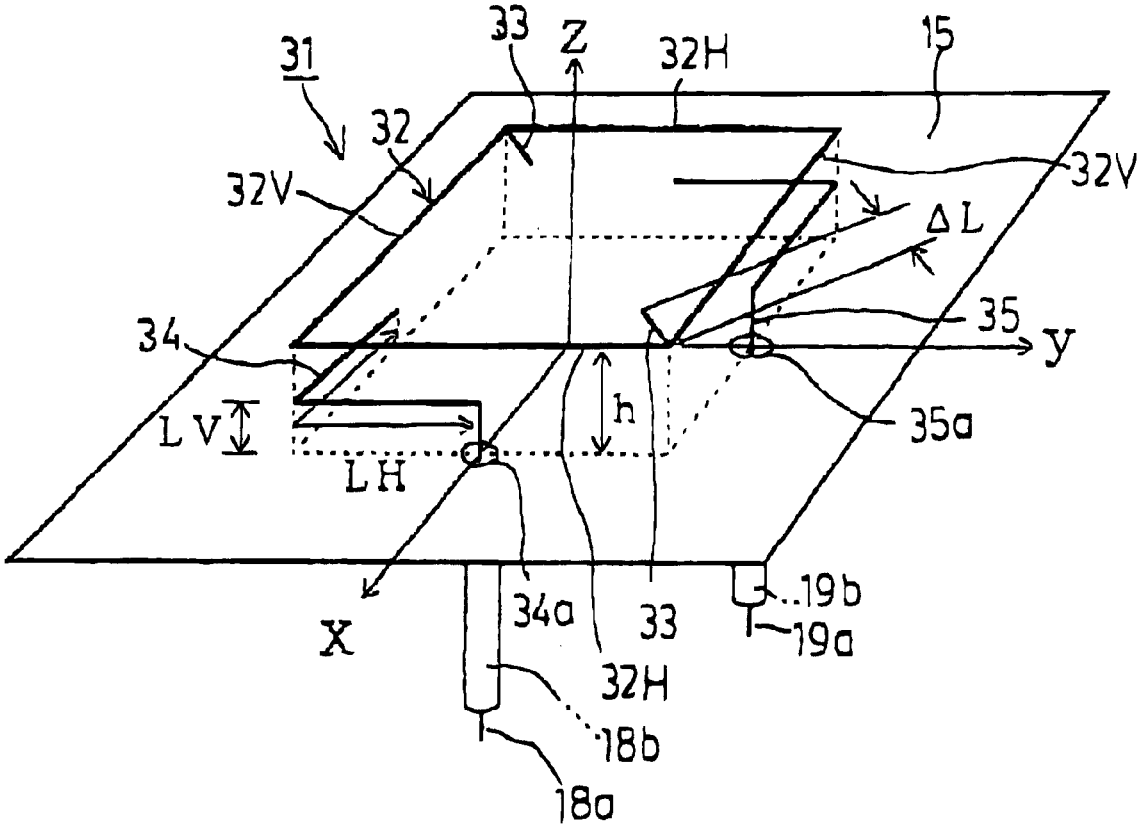
FIG. 8 is a diagram illustrating a plane antenna.

The plane antenna 31 for the circularly polarized waves shown in FIG. 8 comprises a plane antenna element 32 of the shape of a loop provided with two slide element portions 33 having an element length of $\Delta L=0.029\lambda_{1.472}$ as slide elements for synthesizing the circularly polarized waves. As shown, the slide element portions 33 are protruding toward the central direction at two places, i.e., at a corner between the lower horizontal element portion 32H on where a feeding point 34*a* of one feeder conductor 34 is located and a right vertical element portion 32V on where a feeding point 35*a* of another feeder conductor 35 is located, and at a corner at a symmetrical position turned by 180 degrees from the above corner.

When the electric power is fed from the horizontal feeder conductor 34, the phase of the vertically polarized wave component is delayed by 90 degrees behind the phase of the horizontally polarized wave component due to the reactance of the slide element portions 33, and the dextro-rotary polarized waves are radiated in the +Z direction (upward in the drawing) from the plane antenna element 32. When the electric power is fed from the vertical feeder conductor 35, further, the phase of the horizontally polarized wave component is delayed by 90 degrees behind the vertically polarized wave component, and the levo-rotary polarized waves are radiated in the +Z direction from the plane antenna element 32. Upon changing over the horizontal feeder conductor 34 and the vertical feeder conductor 35, the levo-rotary polarized waves and the dextro-rotary polarized waves can be transmitted and received using a single plane antenna 31.

Figure 9A:
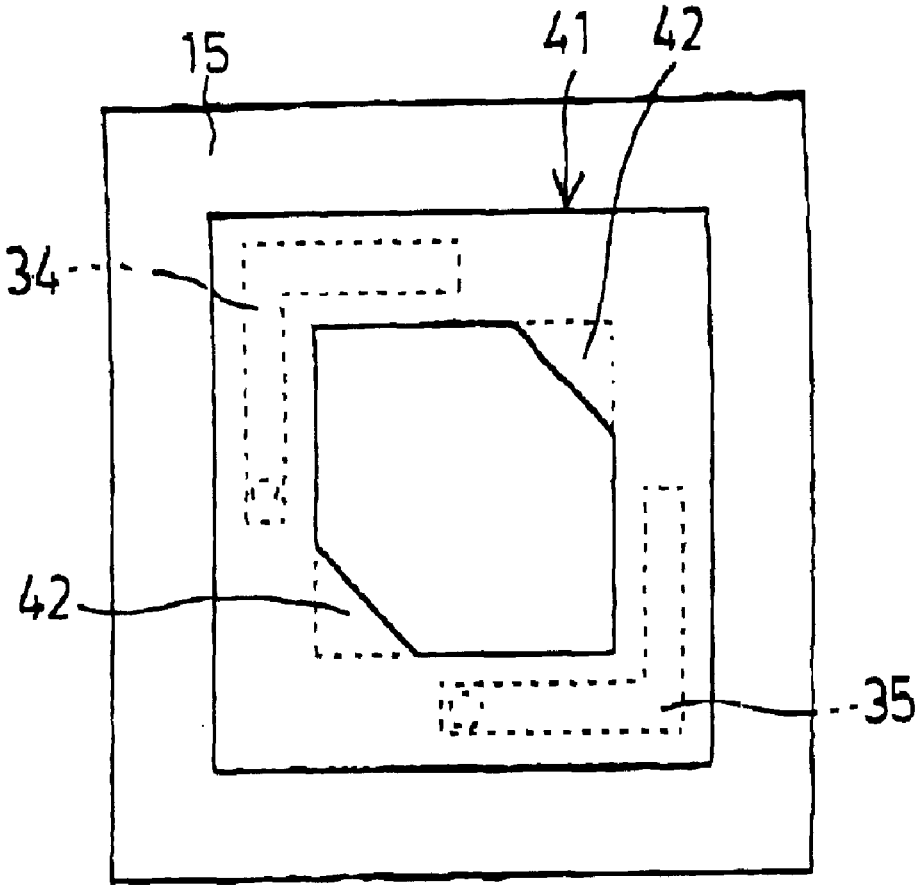
FIG. 9(*a*) is a front view of the plane antenna and FIG. 9(*b*) is a side view thereof.
Figure 9B:
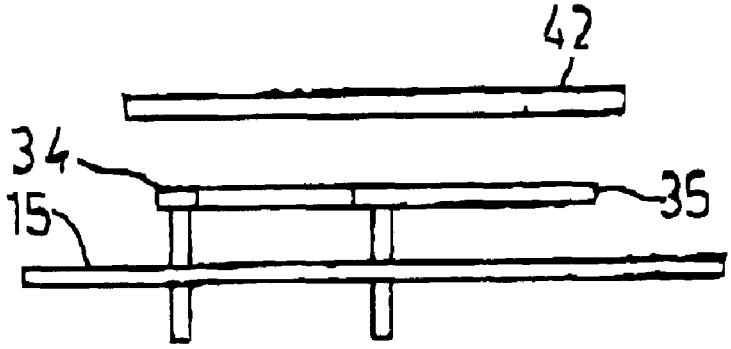

The plane antenna element 41 shown in FIG. 9 comprises a metal plate in which a central hole is formed, and has slide element portions 42 protruding inward from the corners at two places separated by 180 degrees on the inner circumference like the plane antenna element for the circularly polarized waves shown in FIG. 8, to cope with the circularly polarized waves.

Figure 10:
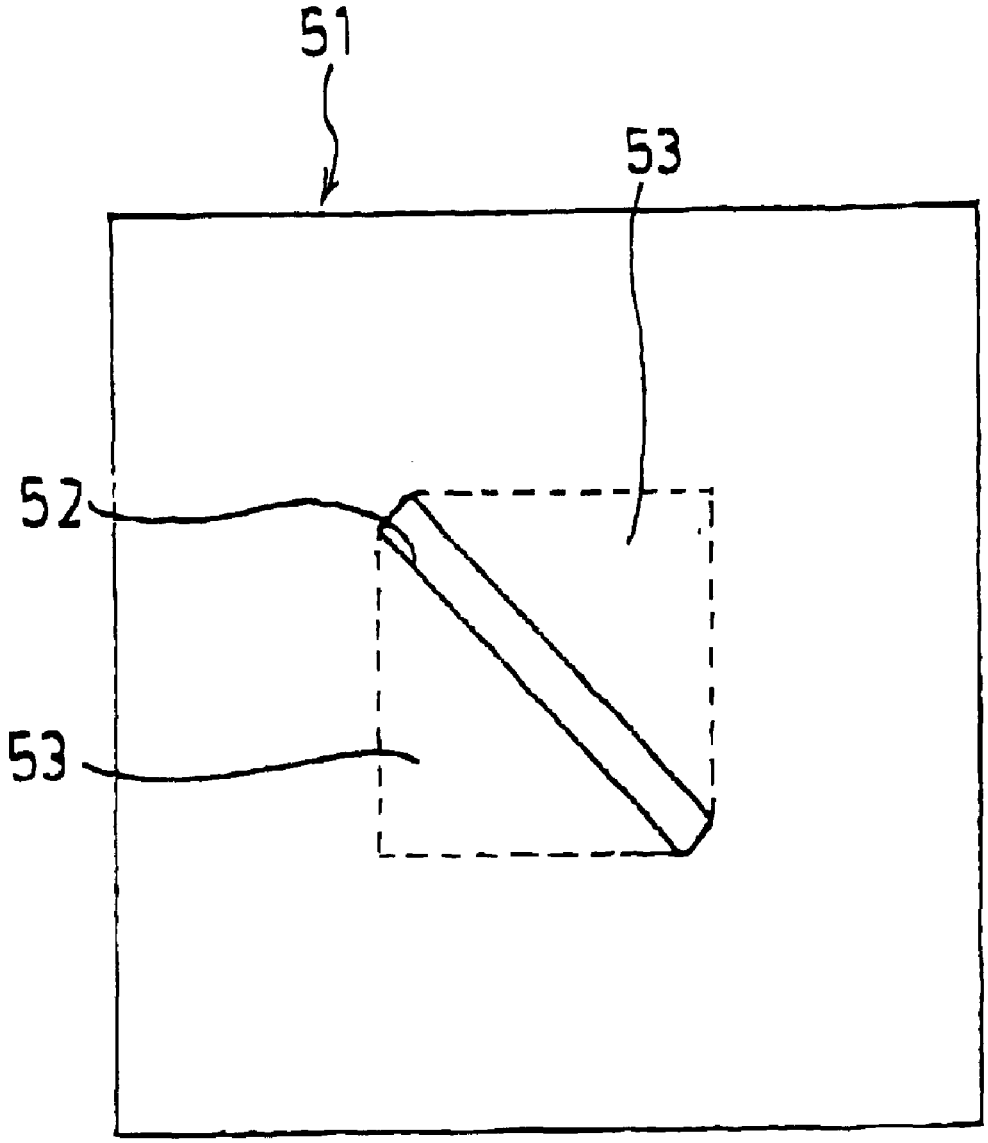
FIG. 10 is a front view of a plane antenna element.

A plane antenna element 51 shown in FIG. 10 comprises a square metal plate having a hole 52 at the center elongated in the radial direction to increase the width of the plane antenna element of the shape of a loop and to increase the areas of the slide element portions 53.

Figure 11:
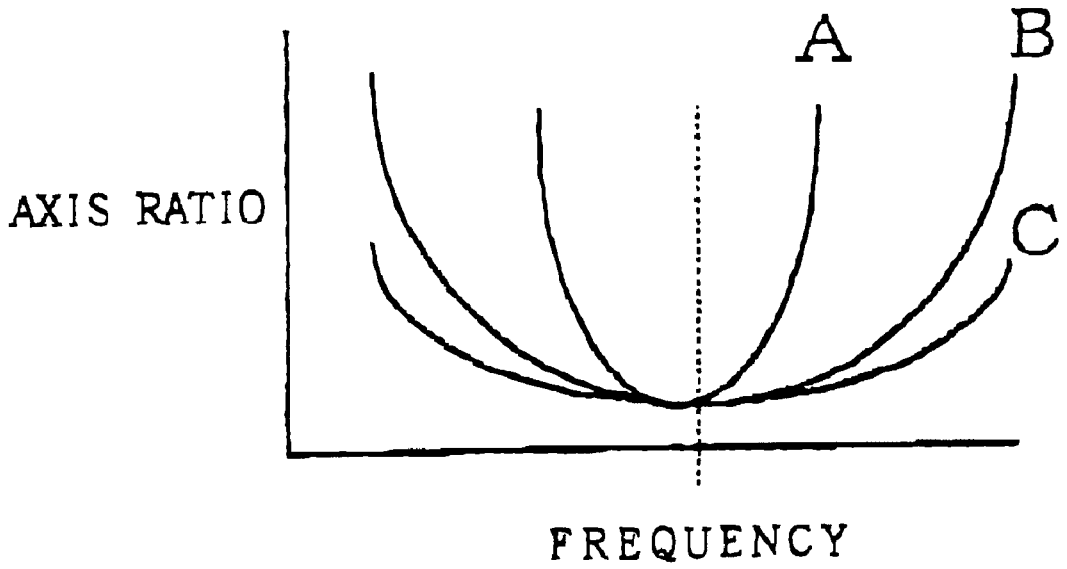
FIG. 11 is a graph showing axis ratio/frequency characteristics of three kinds of plane antennas.

FIG. 11 shows axis ratio characteristics of the plane antennas using plane antenna elements of FIGS. 8, 9 and 10, wherein a curve A represents characteristics of a plane antenna element 32 made of a wire of FIG. 8, a curve B represents characteristics of an antenna element 41 made of a metal plate of FIG. 9, and a curve C represents characteristics of an antenna element 51 made of a metal plate of FIG. 10. The ordinate represents the axis ratio (A.R.), the abscissa represents the frequency (f), and it will be learned that the frequency band increases with an increase in the width of the element, and the antenna element 51 features a broadest frequency band as represented by the curve C.

Figure 12:
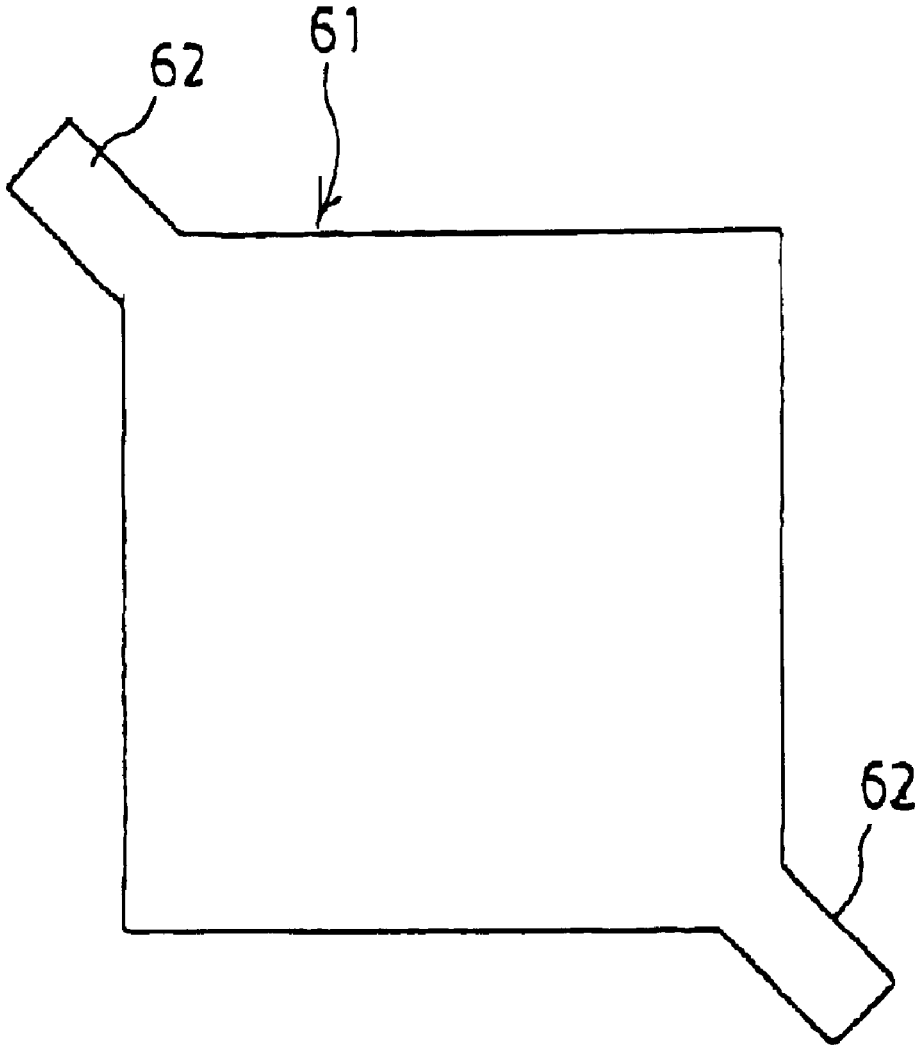
FIG. 12 is a front view of the plane antenna element.

A plane antenna element 61 shown in FIG. 12 has slide element portions 62 protruded in the radial direction from the corners at two opposing places of a square metal plate. This is a modified embodiment from that of FIG. 10. That is, since the width of the plane antenna element 51 of FIG. 10 is increased as much as possible, the elongated hole at the center is extinguished, and the slide element portions 62 are provided on the outer sides.

Though the above-mentioned embodiments have dealt with plane antenna elements of a square shape, the plane antenna element may have a circular shape without being limited to the above-mentioned embodiments. Further, the invention can be modified in a variety of ways within the technical scope of the invention, and the invention encompasses such modified embodiments as a matter of course.

Industrial Applicability

According to the method of feeding electric power to the plane antenna of the present invention as described above, the feeder line is not connected to the plane antenna element, and the electric power is fed to the plane antenna element from the feeder conductor arranged close to the plane antenna element through the electromagnetic coupling. This makes it possible to decrease the input impedance of the plane antenna, to decrease the gap between the antenna element and the ground plane and, hence, to realize an antenna featuring a decreased thickness and high sensitivity. Further, the antenna can be easily assembled since no connection is necessary between the plane antenna element and the feeder line.

Owing to the above-mentioned method, the electric power can be fed to a plane antenna element from the feeder lines of a plurality of systems. Upon feeding the electric power by changing over the feeder lines of the two systems, it is allowed to transmit and receive the electromagnetic waves of two kinds of polarization modes, i.e., the horizontally polarized waves and the vertically polarized waves, or the levo-rotary polarized waves and the dextro-rotary polarized waves, making it possible to realize a plane antenna featuring a decreased thickness and a multiplicity of functions. Upon expanding the width of the loop-shaped plane antenna element, further, the frequency band width is broadened. By employing the feeder conductors of the shape of flat plates, further, the frequency band is more expanded, and the plane antenna features an enhanced practicable performance.

What is claimed is:

1. A method of feeding electric power to a plane antenna in which a plane loop antenna element is arranged in parallel with a ground plane, a feeder conductor is arranged between the plane antenna element and the ground plane, the feeder conductor being in parallel with the peripheral edges of the plane loop antenna element, a central conductor of a coaxial line is connected to an end of the feeder conductor, and an external conductor of the coaxial line is connected to the ground plane so that the electric power is fed from the coaxial line to the plane antenna element through the electromagnetic coupling.

2. A plane antenna in which a plane loop antenna element is disposed in parallel with a ground plane, feeding points of a first feeder conductor and of a second feeder conductor are arranged being separated away by 90 degrees from the center of the plane antenna element, the first feeder conductor and the second feeder conductor are provided in parallel with the peripheral edges of the plane loop antenna element between the plane loop antenna element and the ground plane, the central conductors of coaxial lines of two systems are separately connected to the feeding points of the first feeder conductor and of the second feeder conductor, and the external conductors of the coaxial lines of the two systems are connected to the ground plane to feed electric power from the first feeder conductor or the second feeder conductor to the plane antenna element through the electromagnetic coupling so as to transmit and receive the horizontally polarized waves and the vertically polarized waves.

3. A plane antenna according to claim 2, wherein the plane loop antenna element is the one formed of an electrically conducting wire member in the shape of a closed loop.

4. A plane antenna according to claim 2, wherein the plane loop antenna element is the one of the shape of a closed loop forming a central hole in an electrically conducting plate member.

5. A plane antenna according to claim 2, wherein the feeder conductors are formed of an electrically conducting plate members in the shape of an inverse L-shape.

6. A plane antenna in which a plane antenna element is disposed in parallel with a ground plane, feeding points of a first feeder conductor and of a second feeder conductor are arranged being separated away by 90 degrees from the center of the plane antenna element, the first feeder conductor and the second feeder conductor are provided in parallel with the peripheral edges of the plane antenna element and in the opposite directions relative to each other between the plane antenna element and the ground plane, slide elements are provided for the plane antenna element at positions of an equal distance from the first and second feeding points, the central conductors of coaxial lines of two systems are separately connected to the feeding points of the first feeder conductor and of the second feeder conductor, and the external conductors of the coaxial lines of the two systems are connected to the ground plane to feed electric power from the first feeder conductor or the second feeder conductor to the plane antenna element through the electromagnetic coupling so as to transmit and receive the levo-rotary polarized waves and the dextro-rotary polarized waves.

7. A plane antenna according to claim 6, wherein the plane antenna element is formed of an electrically conducting wire member in the shape of a closed loop, and the slide element is protruded toward the center of the closed loop or toward the direction of radiation from a point of the closed loop or from two points of the closed loop at an angle of 180 degrees as viewed from the center of the closed loop.

8. A plane antenna according to claim 6, wherein the plane antenna element is in the shape of a closed loop formed of an electrically conducting plate having a hole formed at the center thereof, and the slide element is protruded toward the center of the closed loop or toward the direction of radiation from a point of the closed loop or from two points of the closed loop at an angle of 180 degrees as viewed from the center of the closed loop.

9. A plane antenna according to claim 6, wherein the plane antenna element is the one obtained by forming a hole at the center of an electrically conducting plate, the hole being elongated in the radial direction.

10. A plane antenna according to claim 6, wherein the side elements protrude toward the direction of radiation from a point on an outer circumference of the electrically conducting plate or from two points thereof at an angle of 180 degrees as viewed from the center thereof.

11. A plane antenna according to claims 6, wherein the feeder conductors are formed of an electrically conducting plate members in the shape of an inverse L-shape.

12. A plane loop antenna comprising:

a ground plane;

a plane loop antenna element having a peripheral edge formed parallel to said ground plane;

a feeder conductor placed parallel and adjacent to a portion of the peripheral edge of said plane loop antenna element between said ground plane and said plane loop antenna element, said feeder conductor having an end; and a feed line conductor connected to the end of said feeder conductor, whereby the plane loop antenna is capable of transmitting and receiving polarized waves.

13. A plane loop antenna comprising:

a ground plane;

a square plane loop antenna element having peripheral edges formed parallel to said ground plane;

a first feeder conductor placed parallel and adjacent to a portion of two orthogonal peripheral edges of said plane loop antenna element between said ground plane and said plane loop antenna element, said first feeder conductor having a first end;

a second feeder conductor placed parallel and adjacent to a portion of another two orthogonal peripheral edges of said plane loop antenna element between said ground plane and said plane loop antenna element, said second feeder conductor having a second end;

a first feed line conductor connected to the first end of said first feeder conductor; and a second feed line conductor connected to the second end of said second feeder conductor, whereby the plane loop antenna is capable of transmitting and receiving polarized waves.

14. A plane loop antenna as in claim 13 further comprising:

two slide element portions, each of said two slide element portions protruding toward a center of said square plane loop antenna element.

15. A plane loop antenna as in claim 13 wherein:

said square plane loop antenna has a hole elongated in a radial direction.

* * * * *